United States Patent [19]

Zurbuchen et al.

[11] 4,313,733

[45] Feb. 2, 1982

[54] ASSISTANT MIXTURE FOR THE DYEING OR FLUORESCENT BRIGHTENING

[75] Inventors: Jacques Zurbuchen, Kaiseraugst, Switzerland; Alain Lauton, St. Louis; Jean P. Luttringer, Rixheim, both of France

[73] Assignee: Ciba-Geigy Corporation, Ardsley, N.Y.

[21] Appl. No.: 120,233

[22] Filed: Feb. 11, 1980

[30] Foreign Application Priority Data

Feb. 13, 1979 [CH] Switzerland ..... 1402/79

[51] Int. Cl.[3] ..... D06P 1/62; D06P 1/60; D06P 1/613; D06P 1/667

[52] U.S. Cl. ..... 8/582; 8/58.4; 8/588; 252/301.21

[58] Field of Search ..... 8/582, 584, 588; 252/301.21

[56] References Cited

U.S. PATENT DOCUMENTS

| | | | |
|---|---|---|---|
| 3,989,456 | 11/1976 | Vescia et al. | 8/588 |
| 4,071,468 | 1/1978 | Abel et al. | 8/588 |
| 4,072,465 | 2/1978 | Dacuble | 8/582 |
| 4,092,266 | 5/1978 | Abel | 252/321 |
| 4,132,525 | 1/1979 | Berger et al. | 8/588 |
| 4,255,153 | 3/1981 | Althern et al. | 8/582 |

FOREIGN PATENT DOCUMENTS

| | | |
|---|---|---|
| 1161475 | 8/1969 | United Kingdom . |

*Primary Examiner*—Maria Parrish Tungol

*Attorney, Agent, or Firm*—Sprung, Felfe, Horn, Lynch & Kramer

[57] ABSTRACT

A novel assistant mixture containing at least (A) an acid ester, or a salt thereof, of a polyadduct of propylene oxide with a polyfunctional aliphatic amino or hydroxy compound which contains 2 to 9, and preferably 2 to 6, carbon atoms and has at least one amino or hydroxyl group capable of entering into an addition reaction; (B) an acid ester, or a salt thereof, of a polyadduct of an alkylene oxide with a phenol containing at least one alkyl, benzyl or phenyl group and (C) an aliphatic ester, containing at least 6 carbon atoms, of a mono- or di-carboxylic acid and which can be used in the fluorescent or optically brightening or preferably in the dyeing of polyester fibre materials in order to increase the rate of migration of fluorescent or optical brighteners or of disperse dyes.

36 Claims, No Drawings

ASSISTANT MIXTURE FOR THE DYEING OR FLUORESCENT BRIGHTENING

The present invention relates to a novel assistant and its use in the dyeing or fluorescent brightening of polyester fibre materials.

In German Offenlegungsschrift No. 2,758,417, a migration dyeing method using selected disperse dyes is described with which it is possible, without dyeing assistants and without specific control of the rise in temperature in the heating phase, to produce level dyeings of difficult pale and medium shades.

Surprisingly, novel assistants have now been found which permit the use of a broader category of disperse dyes, in particular including dyes with high fastness to sublimation, which have too low a migration rate when no assistants are added and thus tend to give unlevel dyeings if the temperature is not controlled in the heating phase. By the use of the assistants according to the invention, the migration rate is increased to such an extent that level dyeings can be obtained even with these disperse dyes. By virtue of the novel assistants, it is thus possible to dye not only in pale and medium shades but also in deep shades, with good fastness properties.

Accordingly, the present invention relates to an assistant which contains at least (A) an acid ester, or a salt thereof, of a polyadduct of propylene oxide with a polyfunctional aliphatic amino or hydroxy compound which contains 2 to 9, and preferably 2 to 6, carbon atoms and has at least one amino or hydroxyl group capable of entering into an addition reaction; (B) an acid ester, or a salt thereof, of a polyadduct of an alkylene oxide with a phenol containing at least one alkyl, benzyl or phenyl group and (C) an aliphatic ester, containing at least 6 carbon atoms, of a mono- or di-carboxylic acid.

The acid esters of the polypropylene oxide adducts, which comprise component (A), can be in the form of free acids or preferably in the form of salts, for example alkali metal salts or ammonium salts. Alkali metal salts are in particular the sodium or potassium salts and ammonium salts are the ammonium ($NH_4$), trimethylammonium, monoethanolammonium, diethanolammonium and triethanolammonium salts. The sodium or ammonium ($NH_4$) salts are preferred.

The acid esters of polypropylene oxide adducts which are suitable for use as component (A) are prepared by adding propylene oxide onto the aliphatic amino or hydroxy compound of the type defined and converting the adduct to the acid ester, using an oxyacid which is at least dibasic or a functional derivative of this acid, and, if desired, converting the resulting acid ester to the abovementioned salts.

Compounds which have proved particularly suitable as component (A) for use in accordance with the present invention are acid esters, especially sulfuric acid esters, or the salts thereof, of polypropylene oxide adducts, the polyadduct having an average molecular weight of 1,000 to 6,000 and preferably of 2,300 to 4,600. Polyadducts of this type can be prepared, for example, by adding 15 to 100 mols, and preferably 40 to 80 mols, of propylene oxide onto 1 mol of the aliphatic amino or, preferably, hydroxy compound of the type defined.

Hydroxy compounds of the type defined are advantageously polyhydric aliphatic alcohols which contain at least 2 and advantageously 2 to 6 hydroxyl groups and preferably 2 to 6 carbon atoms, for example alkylenediols with an alkylene radical of 2 to 6 carbon atoms, such as ethylene glycol, 1,3- or 1,2-propylene glycol or 1,5-pentanediol, and also glycerol, trimethylolethane or trimethylolpropane, erythritol, pentaerythritol, mannitol or sorbitol. Aliphatic alcohols which contain three carbon atoms and two or three hydroxyl groups, for example propylene glycol and in particular glycerol, are preferably employed.

Amino compounds which can be reacted, as starting materials, with the propylene oxide are, in principle, polyfunctional amines which contain either at least one reactive amino group or at least one reactive hydroxyl group; the reactive amino group can be primary and/or secondary. Compounds which have proved suitable are, in particular, alkylenepolyamines which contain 2 to 6 carbon atoms and 2 to 4 amino groups. Examples of alkylenepolyamines which can be used are ethylenediamine, propylenediamine, butylenediamine, pentylenediamine, hexamethylenediamine, diethylenetriamine, triethylenetetramine, 1,2-propylenediamine, dipropylenetriamine, tripropylenetetramine and dibutylenetriamine. Preferred polyamines are alkylenediamines having 2 or 3 carbon atoms, such as propylenediamine and in particular ethylenediamine.

Further amines which prove particularly valuable are those which contain at least one hydroxyalkyl group and have 2 to 6 carbon atoms, for example hydroxyalkylamines, such as $\beta$-hydroxyethylamine, $\beta$- or $\gamma$-hydroxypropylamine or $\beta,\gamma$-dihydroxypropylamine; bis-hydroxyalkylamines, such as bis-($\beta$-hydroxyethyl)-amine, bis-($\gamma$-hydroxypropyl)-amine or bis-($\alpha$-methyl-$\beta$-hydroxyethyl)amine; tris-hydroxyalkylamines, such as tris-($\beta$-hydroxyethyl)-amine; and N-alkyl-N-hydroxyalkylamines, such as N-methyl- or N-ethyl-N-$\gamma$-hydroxypropylamine. Monoisopropanolamine and $\beta$-ethanolamine are preferred.

Both the propylene oxide addition reaction and the esterification can be carried out by known methods.

Polybasic oxy-acids which can be used to form the acid esters are organic, preferably aliphatic, mono- or di-carboxylic acids of 3 to 6 carbon atoms, which can be sulfonated, for example maleic acid or sulfosuccinic acid, or, in particular, polybasic, inorganic oxy-acids, for example sulfuric acid. In place of the acids it is also possible to use the functional derivatives thereof, such as acid anhydrides, acid halides, acid esters or acid amides. Examples of these functional derivatives are sulfur trioxide and in particular chlorosulfonic acid and sulfamic acid.

The esterification is as a rule carried out by simple mixing of the reactants with warming, advantageously to a temperature between 25° C. and 100° C. The free acids first formed can subsequently be converted to the corresponding alkali metal salts or ammonium salts. Conversion to the salts is effected in the customary manner by the addition of bases, for example ammonia, monoethanolamine, triethanolamine or alkali metal hydroxides, for example sodium hydroxide or potassium hydroxide. According to a particularly preferred procedure, the acid sulfuric acid esters are prepared direct in the form of their ammonium salts by warming the propylene oxide adducts with sulfamic acid, advantageously in the presence of urea.

British patent specifications 1 510 331 and 1 540 640 give further details on the composition of the acid esters suitable for use as component (A) and also describe the preparation of these esters.

The anionic phenolglycol ethers suitable for use as component (B) are advantageously acid adducts of 1 to 60 mols of alkylene oxides, and especially 1 to 60 mols of ethylene oxide and/or propylene oxide, and, if desired, in addition 1 mol of styrene oxide, with phenols which contain at least one benzyl group, one phenyl group or, preferably, one alkyl group having at least 4 carbon atoms, for example benzylphenol, dibenzylphenol, dibenzyl-(nonyl)phenol, o-phenylphenol, butylphenol, tributylphenol, octylphenol, nonylphenol, dodecylphenol or pentadecylphenol, the said adducts containing ester groups of inorganic or organic acids.

Very suitable components (B) preferably have the formula $$R-O\left(CH(Y_1)-CH(Y_2)-O\right)_m-X \qquad (1)$$

in which R is alkylphenyl having 4 to 16 carbon atoms in the alkyl moiety or o-phenylphenyl, one of $Y_1$ and $Y_2$ is hydrogen or methyl and the other is hydrogen, X is the acid radical of an inorganic, oxygen-containing acid, for example orthophosphoric acid or sulfuric acid, and m is 1 to 30 and preferably 2 to 15. The alkyl radical in alkylphenyl is preferably in the para-position.

The acid radical can be in the form of a salt, i.e., for example, in the form of an alkali metal, alkaline earth metal, ammonium or amine salt. Preferred compounds (B) are anionic surfactants of the formula

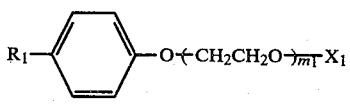

(2)

in which $R_1$ is octyl or nonyl, $m_1$ is 2 to 15 and $X_1$ is derived from sulfuric acid or preferably from o-phosphoric acid, and the surfactants are in the form of the free acids or of the sodium or ammonium salts. The acid phosphoric acid ester of the adduct of 10 mols of ethylene oxide with 1 mol of p-nonylphenol is of particular interest.

The aliphatic esters which comprise component (C) are advantageously esters, having 6 to 24 carbon atoms, of aliphatic mono-or di-carboxylic acids with aliphatic alcohols of 1 to 18 carbon atoms. Suitable esters are the methyl, ethyl, n-propyl, iso-propyl, n-butyl and isobutyl, hexyl, heptyl, octyl, 2-ethyl-hexyl, nonyl, 2-methyl-octyl, alfol, decyl, dodecyl, cetyl and stearyl esters of acetic acid, propionic acid, butyric acid, caproic acid, oenathic acid, caprilic acid, capric acid, pelargonic acid, lauric acid, myristic acid, palmitic acid, stearic acid, coconut fatty acid, tallow fatty acid, behenic acid, oleic acid, linoleic acid, linolenic acid, ricinoleic acid and eicosenoic acid, the number of carbon atoms in the esters advantageously being 6 to 24 in each case. The alfols are linear primary alcohols. The number after the name indicates the average number of carbon atoms in the alcohol. Some representatives of these alfols are alfol (8–10), alfol (10–14) and alfol (16–18).

Esters preferably used as component (C) are aliphatic diesters of dicarboxylic acids, for example of malonic acid, succinic acid, glutaric acid, adipic acid, pimelic acid, suberic acid, azelaic acid or sebacic acid, with aliphatic alcohols of 3 to 12 carbon atoms, for example propyl alcohol, butyl alcohol, hexyl alcohol, octyl alcohol, 2-ethyl-hexyl alcohol, nonyl alcohol or 2-methyl-octyl alcohol, the number of carbon atoms in the diesters preferably being between 10 and 24.

Particularly suitable esters are the dipropyl, dibutyl or di-(2-ethyl-hexyl) ester of succinic acid, the dipropyl, dibutyl or di-(2-ethylhexyl) ester of glutaric acid and the dipropyl, dibutyl or di-(2-ethyl-hexyl) ester of adipic acid and especially mixtures of these diesters, in particular mixtures of the dibutyl esters.

Preferred assistants are obtained from at least the following components: (Aa) a sulfuric acid ester, or a salt thereof, of a polyadduct of 40 to 80 mols of propylene oxide with a dihydric to hexahydric aliphatic alcohol of 2 to 6 carbon atoms, (Bb) an acid ester, preferably a phosphoric acid ester, or a salt thereof, of a polyadduct of 2 to 20 mols of ethylene oxide and/or propylene oxide with a p-alkylphenol having 4 to 16 carbon atoms in the alkyl radical and (Cc) an aliphatic diester, having 10 to 24 carbon atoms, of an aliphatic dicarboxylic acid.

Preferably, the assistant mixture according to the invention additionally contains, as component (d) an anionic or amphoteric ester, or a salt thereof, of a polyadduct of 2 to 50 mols of an alkylene oxide with an aliphatic monoamine of 8 to 24 carbon atoms and in particular 10 to 18 carbon atoms.

Component (D) can be represented by the formula $$\left[Z-N\left(CH(Y_3)-CH(Y_4)-O\right)_r\left(CH(Y_3)-CH(Y_4)-O\right)_s\right]^{Q}_{(Q)_{p-1}(H)_{2-p}} \qquad (3)$$

in which Z is an aliphatic hydrocarbon radical having 8 to 24 and preferably 10 to 18 carbon atoms, one of $Y_3$ and $Y_4$ is hydrogen, methyl or phenyl and the other is hydrogen, the two Q's, on their own or together, are the acid radical of an inorganic, oxygen-containing acid or of an aliphatic dicarboxylic acid, p is 1 or 2 and r and s are integers, the sum of r and s being 2 to 50 and preferably 2 to 15.

In formula (3), Z is preferably an alkyl or alkenyl radical having 8 to 22 and especially 10 to 18 carbon atoms. $Y_3$ and $Y_4$ are preferably hydrogen. The sum of r+s is advantageously 6 to 15. p is preferably 2.

Alkyl radicals Z are, for example, octyl, decyl, dodecyl, myristyl, hexadecyl, heptadecyl, octadecyl, arachidyl or behenyl. Alkenyl radicals Z can be, for example, dodecenyl, hexadecenyl, oleyl or octadecenyl.

The aliphatic amines which are required as starting materials for the preparation of the adducts of the formula (3) can contain saturated or unsaturated, branched or unbranched hydrocarbon radicals. The amines can be single chemical compounds or can be in the form of mixtures. Mixtures of amines used are preferably those which are formed during the conversion of natural fats or oils, for example tallow fat, soya bean oil or coconut oil, into the corresponding amines. Specific amines are dodecylamine, hexadecylamine, heptadecylamine, octadecylamine, tallow fatty amine, arachidylamine, behenylamine and octadecenylamine (oleylamine).

Ethylene oxide, propylene oxide or styrene oxide can be added onto the amines. Advantageously, 2 to 30 mols of ethylene oxide, propylene oxide, styrene oxide or mixtures thereof are used per 1 mol of amine. Propylene oxide and styrene oxide are preferably employed in the form of mixtures with ethylene oxide. In this case, advantageously, 1 to 3 mols of propylene oxide or styrene oxide and at least 3 mols or, respectively, 5 mols of ethylene oxide are used per 1 mol of amine.

The acid radical Q in the formula (3) is derived, for example, from aliphatic dicarboxylic acids having preferably 2 to 6 carbon atoms, for example maleic acid, malonic acid, succinic acid or sulfosuccinic acid, and is bonded via an ester bridge to the alkyleneoxy moiety of the molecule. In particular, however, Q is derived from inorganic polybasic acids, for example sulfuric acid or, preferably, orthophosphoric acid.

The acid radical Q is preferably in the form of a salt, i.e., for example, in the form of an alkali metal, alkaline earth metal, ammonium or amine salt. Examples of such salts are the lithium, sodium, potassium, calcium, ammonium, trimethylamine, ethanolamine, diethanolamine or triethanolamine salts. Sodium salts and ammonium salts are preferred.

Particularly suitable components (D) are compounds of the formula

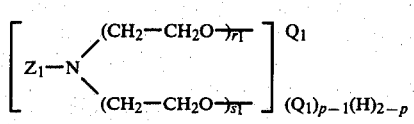

(4)

in which $Z_1$ is alkenyl or in particular alkyl having 10 to 18 carbon atoms and p is 1 or 2, the sum of $r_1$ and $s_1$ is 2 to 15 and especially 6 to 10 and the two Q's are derived from sulfuric acid or, individually or together, from o-phosphoric acid, and the compounds are in the form of the free acids or of the sodium or ammonium salts. In the case of esterification with orthophosphoric acid, it is in the main mixtures which form and these consist, for example, of compounds of the formulae

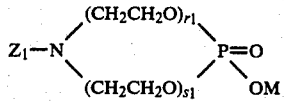

(4a)

and

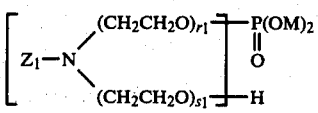

(4b)

in which $Z_1$, $r_1$ and $s_1$ are as defined and M is hydrogen, ammonium or sodium. The weight ratio of the compound of the formula (4*a*) to the compound of the formula (4*b*) is advantageously 2:1 to 1:1.

The phosphoric acid ester of the adduct of 8 mols of ethylene oxide with 1 mol of dodecylamine is of particular interest.

As well as components (A), (B), (C) and, if desired, (D), the assistant mixture can also additionally contain, as component (E), polypropylene glycol or an adduct of propylene oxide with a trihydric to hexahydric aliphatic alcohol of 3 to 6 carbon atoms, for example glycerol or pentaerythritol, both the polypropylene glycol and the polypropylene oxide adduct having an average molecular weight of 250 to 1,800 and preferably of 400 to 900. An addition of this type serves to improve the homogeneity of the emulsion formed in the dyebath.

The novel dyeing assistant preparations can be prepared by simply stirring the said components (A), (B), (C) and, if desired, (D), and (E) together with water, whereupon homogeneous clear mixtures are obtained which are stable on storage at room temperature. Clear preparations can also be prepared without water. The weight ratio of component (A) to component (B) advantageously varies between 1:4 and 2:1 and preferably between 1:3 and 1:1, that of component (A) to component (C) advantageously varies between 1:8 and 1:2 and preferably between 1:6 and 1:3 and, where appropriate, that of component (A) to component (D) advantageously varies between 1:3 and 3:1 and preferably between 2:1 and 1:2.

The dyeing assistant preparations advantageously contain 5 to 20 percent by weight of component (A), 10 to 40 percent by weight of component (B), 15 to 60 percent by weight of component (C), 0 to 30, preferably 2 to 25, percent by weight of component (D), 0 to 15, preferably 3 to 10 percent by weight of component (E) and 0 to 40, preferably 5 to 30, percent by weight of water, the percentages in each case being based on the preparation.

The novel dyeing assistant preparations increase the rate of diffusion of the dyes into the fibres and thus accelerate the migration of the dyes when dyeing polyester fibre materials, preferably linear polyester fibres. Accordingly, the present invention also relates to a process for the level dyeing or fluorescent brightening of polyester fibre material with disperse dyes or fluorescent brighteners, which is characterised in that this material is dyed or subjected to fluorescent brightening in the presence of the assistant according to the invention.

The amounts in which the assistant according to the invention is added to the dyebaths or brightener liquors vary between 0.5 and 6 g and preferably between 2 and 4 g per liter of dye liquor or brightener liquor.

Polyester fibre materials, especially textile material, which can be dyed or subjected to fluorescent brightening in the presence of the novel assistant mixture are, for example, cellulose ester fibres, such as cellulose 2½-acetate fibres and cellulose triacetate fibres, and especially linear polyester fibres. Linear polyester fibres are to be understood as meaning synthetic fibres which are obtained, for example, by a condensation reaction of terephthalic acid with ethylene glycol or of isophthalic acid or terephthalic acid with 1,4-bis-(hydroxymethyl)-cyclohexane, and also copolymers of terephthalic acid and isophthalic acid and ethylene glycol. The linear polyester virtually exclusively employed hitherto in the textile industry consists of terephthalic acid and ethylene glycol.

The fibre materials can also be used in the form of mixed fabrics, with one another or with other fibres, for example mixtures of polyacrylonitrile/polyester, polyamide/polyester, polyester/cotton, polyester/viscose and polyester/wool.

The textile material to be dyed can be in diverse states of processing. Examples are loose material, piece goods, such as knitted fabrics or woven fabrics, or yarn in the form of wound yarn or in muff form. The latter can have winding densities of 300 to 600 g/cm$^3$ and in particular 400 to 450 g/cm$^3$.

The disperse dyes to be used, which are only very slightly soluble in water and most of which are in the form of a fine dispersion in the dye liquor, can belong to very diverse categories of dyes, for example the acridone, azo, anthraquinone, coumarin, methine, perinone, quinophthalone, naphtho-quinone-imine, styryl or nitro dyes.

Mixtures of disperse dyes can also be used according to the invention.

The novel assistant mixtures can also be employed when whitening undyed polyester fibre materials with optical or fluorescent brighteners dispersed in water.

The fluorescent brighteners which can be used according to the invention are in particular fluorescent brighteners of the coumarin, benzocoumarin, pyrazine, pyrazoline, oxazine, triazolyl, benzoxazolyl, benzofuran, benzimidazolyl or naphthalimide series which are sparingly soluble in water.

Disperse dyes and fluorescent brighteners which are particularly suitable are those which, without the addition of assistants, have a migration time of half dyeing t/2 of at least 40 and preferably of at least 50 minutes at 130° C. The migration time of half dyeing t/2 is the time in which an undyed polyester fibre material which is treated together with a dyed piece of the same material, the pieces being of the same size, at 130° C. in an aqueous liquor is so dyed that its amount of dye is 50% of the amount for the dyed material. These dyes are suitable, in particular, for the production of level mixed shade dyeings, including dichromatic dyeing or trichromatic dyeing. Trichromatic dyeing is understood as meaning, in particular, a three-component combination of the primary colours yellow (or orange), red and blue.

The amount of dyes or fluorescent brighteners to be added to the liquor depends on the desired depth of colour; in general, amounts of 0.001 to 10 and preferably of 0.001 to 5 percent by weight, based on the textile material used, have proved suitable.

The assistants to be used according to the invention can also be employed as a mixture with known carriers based on, for example, di- or tri-chlorobenzene, methyl- or ethyl-benzene, o-phenylphenol, benzylphenol, diphenyl ether, chlorodiphenyl, methyldiphenyl, cyclohexanone, acetophenone, alkylphenoxyethanol, mono-, di- or tri-chlorophenoxyethanol or -propanol, pentachlorophenoxyethanol or alkylphenylbenzoates, or, in particular, based on diphenyl, methyldiphenyl ether, dibenzyl ether, methyl benzoate, butyl benzoate or phenyl benzoate.

The carriers are preferably used in an amount of 0.5 g to 2 g/l of liquor or 10 to 60 percent by weight, based on the dyeing assistant preparation.

Depending on the textile material to be treated, the dyebaths or brightener liquors can also contain, in addition to the dyes or fluorescent brighteners, and the assistant according to the invention, oligomeric inhibitors, antifoams, crease-free agents and preferably dispersants.

The dispersants serve in particular to obtain a good state of fine division of the disperse dyes. The dispersants generally customary when dyeing with disperse dyes can be used. Suitable dispersants are, for example, anionic surfactants, and these can be present on their own or in the form of mixtures.

Examples of suitable anionic surfactants are: sulfated aliphatic alcohols in which the alkyl chain has 8 to 18 carbon atoms; for example sulfated lauryl alcohol, oleyl alcohol or coconut fatty alcohol; sulfated unsaturated fatty acids or fatty acid lower alkyl esters which have 8 to 20 carbon atoms in the fatty radical, for example oleic acid or ricinoleic acid and oils containing such fatty acids, for example castor oil; alkylsulfonates, in which the alkyl chain contains 8 to 20 carbon atoms, for example dodecylsulfonate; alkylarylsulfonates with a straight-chain or branched alkyl chain having at least 6 carbon atoms, for example nonyl-or dodecyl-benzenesulfonates or 3,7-diisobutyl-naphthalenesulfonates; sulfonates of polycarboxylic acid esters, for example dioctylsulfosuccinates; those alkali metal, ammonium or amine salts of fatty acids having 10 to 20 carbon atoms which are termed soaps, for example colophony salts; esters of polyalcohols, especially monoglycerides or diglycerides of fatty acids having 12 to 18 carbon atoms, for example monoglycerides of lauric acid, stearic acid or oleic acid; and the adducts of 1 to 60 mols of ethylene oxide and/or propylene oxide with fatty acids, fatty acid amides or fatty alcohols, each having 8 to 22 carbon atoms, which have been converted to an acid ester using an organic dicarboxylic acid, for example maleic acid, malonic acid or sulfosuccinic acid, but preferably using an inorganic polybasic acid, such as o-phosphoric acid or, in particular, sulfuric acid.

Anionic dispersing agents which have proved particularly advantageous are ligninsulfonates, polyphophates and, preferentially, formaldehyde condensation products obtained from aromatic sulfonic acids, formaldehyde and, if desired, monofunctional or difunctional phenols, for example obtained from cresol, β-naphtholsulfonic acid and formaldehyde, from benzenesulfonic acid, formaldehyde and naphthalenesulfonic acid, from naphthalenesulfonic acid and formaldehyde or from naphthalenesulfonic acid, dihydroxydiphenylsulfone and formaldehyde.

The disodium salt of di-(6-sulfonaphth-2-yl)methane is preferred.

Mixtures of anionic dispersants can also be used. Usually, the anionic dispersants are in the form of their alkali metal salts, ammonium salts or amine salts.

These dispersants are preferably used in an amount of 0.1 to 5 g/l of liquor.

The dyebaths or fluorescent brightener liquors can also contain a water-soluble alkaline earth metal salt, aluminum salt or organic ammonium salt of a monobasic or polybasic aliphatic carboxylic acid or of a monobasic or polybasic inorganic acid. Depending on the type of dye used, the stability of the dispersion in the dyebath can be greatly improved by the addition of these salts, especially when dyeing polyester wound packages with very high winding densities. It is thus possible to prevent or significantly reduce deposits of dye. These additional salts are water-soluble salts, for example the magnesium, calcium, barium, strontium, aluminium or organic ammonium salts of monobasic or polybasic inorganic acids or monobasic or polybasic aliphatic carboxylic acids, such as hydrochloric acid, hydrobromic acid, hydrofluoric acid, nitric acid, sulfuric acid, phosphoric acid or formic acid, acetic acid and thiocyanic acid. Examples of salts of this type are: calcium nitrate, magnesium nitrate, aluminium nitrate, calcium chloride, magnesium chloride, magnesium thiocyanate and calcium thiocyanate, or organic ammonium chlorides, bromides and iodides, for example methonium salts (alkane-bis-trimethylammonium salts). Examples of suitable methonium salts are pentamethonium iodide, decamethonium bromide and in particular hexamethonium chloride.

Salts are also to be understood as meaning complexes of the abovementioned cations with monobasic or polybasic organic acids which release the cation under the dyeing conditions.

The best results are obtained with alkaline earth metal salts, in particular with calcium salts or magnesium salts, of monobasic inorganic acids or monobasic aliphatic carboxylic acids, but in particular with calcium chloride or magnesium chloride.

These salts are preferably used in an amount of 0.1 to 3 g per liter of dye liquor or of brightener liquor, or 0.2 to 5 percent by weight, based on the fibre material.

Furthermore, the dyebaths and brightener liquors can contain customary additives, advantageously electrolytes, such as salts, for example sodium sulfate, ammonium sulfate, sodium phosphates or polyphosphates or ammonium phosphates or polyphosphates, ammonium acetate or sodium acetate, and/or acids, for example mineral acids, such as sulfuric acid or phosphoric acid, or organic acids, advantageously lower aliphatic carboxylic acids, such as formic acid, acetic acid or oxalic acid. The acids serve in particular to adjust the pH of the liquors used according to the invention to the desired value, which as a rule is 4 to 6.5 and preferably 4.5 to 5.5.

Dyeing or fluorescent brightening is advantageously effected from an aqueous liquor by the exhaust method. The liquor ratio can accordingly be chosen within a wide range, for example 1:4 to 1:100 and preferably 1:10 to 1:50. The temperature at which dyeing or fluorescent brightening is carried out is at least 70° C. and as a rule does not exceed 140° C. Preferably, it is in the range of 80° to 135° C.

Linear polyester fibres and cellulose triacetate fibres are preferably dyed by the so-called high temperature method in closed equipment, which advantageously is also pressure-resistant, at temperatures of above 100° C. and preferably of between 110° and 135° C., and if desired under pressure. Examples of suitable closed vessels are circulating liquor machines, such as cheese or beam dyeing machines, winches, jet or drum dyeing machines, muff dyeing machines, paddle dyeing machines or jiggers.

Cellulose 2½-acetate fibres are preferably dyed at temperatures of 80°–85° C.

The dyeing process according to the invention can be carried out either by first treating the goods to be dyed briefly with the dyeing assistant and then dyeing, or preferably by treating the goods to be dyed with the assistant and the dye at the same time.

Preferably, the goods to be dyed are left to work for 5 minutes at 60°–80° C. in a bath which contains the dye, the assistant mixture and, if desired, further additives and has been adjusted to a pH value of 4.5 to 5.5, the temperature is raised to 110° to 135° C., preferably 130° C., in the course of 15 to 25 minutes and the dye liquor is kept at this temperature for 30 to 120 minutes, preferably for 60 minutes.

The dyeings are finished by cooling the dye liquor to 60° to 80° C. and rinsing the dyeings with water, and, if necessary, by cleaning in the conventional manner in an alkaline medium under reductive conditions. The dyeings are then again rinsed and dried. If carriers are used, the dyeings are advantageously also subjected to a heat treatment, for example a thermosol treatment, in order to improve the fastness to light and this treatment is preferably carried out at 160° to 180° C. for 30 to 90 seconds.

Level and strong dyeings are obtained by the process according to the invention on polyester fibre material and especially on linear polyester fibres. Due to the fact that dyes fast to sublimation can also be employed, high fastness is obtained even with deep shades. The use of the assistant mixture employed according to the invention has hardly any influence on the fastness to light.

Compared with known processes, which likewise use disperse dyes which do not migrate or migrate to only a moderate extent, the process according to the invention is distinguished by a shorter heating phase and by the possibility of adding the dye to the liquor at any desired temperature. In particular, the migration time of half dyeing t/2 of disperse dyes, which as a rule is in the range of 50 to 120 minutes when no assistants are added, can be shortened to less than 45 minutes by the use of the assistant mixture employed according to the invention. Because of the improved migration ability of the dyes, any unlevelness in the exhaustion phase of the dyes can be evened out by subsequent migration in the dwell phase at the final temperature. To summarise, the dyeing process using the assistant mixture according to the invention offers the following advantages: uncontrolled heating-up of the liquor to the dyeing temperature without special attention being paid to the significant or critical rate of dyeing; markedly rapid migration of the disperse dyes under high temperature conditions, migration being effected as solid migration with very slight retention, with the production of a level colour shade; shading under conventional high temperature conditions, by virtue of the improved migration of the disperse dyes; simple, streamlined and reliable procedure; simple correction of off-shade dyeings, since better levelling takes place; the production of level single-shade and in particular mixed-shade dyeings, including trichromatic dyeings, with good fastness properties, for example good fastness to light, rubbing and sublimation, with the avoidance of streakiness and even under difficult circumstances; work is in the main carried out without the addition of conventional carriers, dispersants and/or levelling agents; and the production of level dyeings in the case of difficult pale and medium shades and in particular in the case of deep shades, using dyes fast to sublimation.

In the following examples, parts and percentages are by weight. The following reaction products are examples of components (A), (B) and (D).

COMPONENT (A)

$A_1$: The ammonium salt of the formula $$\begin{array}{l} CH_2-O-(C_3H_6O)_x-SO_3NH_4 \\ | \\ CH-O-(C_3H_6O)_y-SO_3NH_4 \quad x+y+z=71 \\ | \\ CH_2-O-(C_3H_6O)_z-SO_3NH_4 \end{array} \tag{11}$$

$A_2$: The ammonium salt of the formula $$\begin{array}{l} CH_2-O-(C_3H_6O)_{x_1}-SO_3NH_4 \\ | \\ CH-O-(C_3H_6O)_{y_1}-SO_3NH_4 \quad x_1+y_1+z_1=54 \\ | \\ CH_2-O-(C_3H_6O)_{z_1}-SO_3NH_4 \end{array} \tag{12}$$

$A_3$: The ammonium salt of the acid sulfuric acid ester of the adduct of 43 mols of propylene oxide with 1 mol of trimethylolpropane;

$A_4$: The ammonium salt of the acid sulfuric acid ester of the adduct of 8 mols of propylene oxide with 1 mol of pentaerythritol;

$A_5$: The sodium salt of the acid sulfosuccinic acid monoester of the adduct of 60 mols of propylene oxide with 1 mol of glycerol;

$A_6$: The ammonium salt of the acid sulfuric acid ester of the adduct of 50 mols of propylene oxide with 1 mol of ethylene glycol;

$A_7$: The ammonium salt of the acid sulfuric acid ester of the adduct of 50 mols of propylene oxide with 1 mol of 1,2-propylene glycol;

$A_8$: The ammonium salt of the acid sulfuric acid ester of the adduct of 60 mols of propylene oxide with 1 mol of ethylenediamine;

$A_9$: The ammonium salt of the acid sulfuric acid ester of the adduct of 60 mols of propylene oxide with 1 mol of monoisopropanolamine.

COMPONENT (B)

$B_1$: The ammonium salt of the acid sulfuric acid ester of the adduct of 3 mols of ethylene oxide with 1 mol of butylphenol;

$B_2$: The ammonium salt of the acid sulfuric acid ester of the adduct of 5 mols of ethylene oxide with 1 mol of tributylphenol;

$B_3$: The ammonium salt of the acid sulfuric acid ester of the adduct of 2 mols of ethylene oxide with 1 mol of nonylphenol;

$B_4$: The ammonium salt of the acid sulfuric acid ester of the adduct of 10 mols of propylene oxide and 10 mols of ethylene oxide with 1 mol of nonylphenol;

$B_5$: The ammonium salt of the acid sulfuric acid ester of the adduct of 35 mols of ethylene oxide with 1 mol of nonylphenol;

$B_6$: The ammonium salt of the acid sulfuric acid ester of the adduct of 50 mols of ethylene oxide with 1 mol of nonylphenol;

$B_7$: The ammonium salt of the acid sulfuric acid ester of the adduct of 15 mols of propylene oxide with 1 mol of nonylphenol;

$B_8$: The ammonium salt of the acid sulfuric acid ester of the adduct of 6 mols of ethylene oxide with 1 mol of dodecylphenol;

$B_9$: The ammonium salt of the acid sulfuric acid ester of the adduct of 6 mols of ethylene oxide with 1 mol of pentadecylphenol;

$B_{10}$: The ammonium salt of the acid sulfuric acid ester of the adduct of 8 mols of ethylene oxide with 1 mol of o-phenylphenol;

$B_{11}$: The sodium salt of the acid maleic acid ester of the adduct of 2 mols of ethylene oxide with 1 mol of p-nonylphenol;

$B_{12}$: The sodium salt of the acid sulfosuccinic acid monoester of the adduct of 2 mols of ethylene oxide with 1 mol of p-nonylphenol;

$B_{13}$: The ammonium salt of the acid phosphoric acid ester of the adduct of 2 mols of ethylene oxide with 1 mol of nonylphenol;

$B_{14}$: The acid phosphoric acid ester of the adduct of 10 mols of ethylene oxide with 1 mol of p-nonylphenol;

$B_{15}$: The sodium salt of the acid sulfuric acid ester of the adduct of 15 mols of ethylene oxide with 1 mol of dibenzyl-(nonyl)-phenol;

$B_{16}$: The sodium salt of the acid sulfuric acid ester of the adduct of 12 mols of ethylene oxide with 1 mol of dibenzyl-phenol.

COMPONENT (D)

$D_1$: The ammonium salt of the acid sulfuric acid diester of the adduct of 2.5 mols of ethylene oxide with 1 mol of tallow fatty amine;

$D_2$: The ammonium salt of the acid sulfuric acid diester of the adduct of 4 mols of ethylene oxide with 1 mol of tallow fatty amine;

$D_3$: The ammonium salt of the acid sulfuric acid diester of the adduct of 6 mols of ethylene oxide with 1 mol of tallow fatty amine;

$D_4$: The ammonium salt of the acid sulfuric acid diester of the adduct of 8 mols of ethylene oxide with 1 mol of tallow fatty amine;

$D_5$: The ammonium salt of the acid sulfuric acid diester of the adduct of 3 mols of propylene oxide and 5 mols of ethylene oxide with 1 mol of tallow fatty amine;

$D_6$: A mixture of the phosphoric acid monoester and diester (1:2) of the adduct of 8 mols of ethylene oxide with 1 mol of dodecylamine;

$D_7$: The ammonium salt of the acid phosphoric acid ester of the adduct of 8 mols of ethylene oxide with 1 mol of tallow fatty amine;

$D_8$: The sodium salt of the acid di-(sulfosuccinic acid) half-ester of the adduct of 8 mols of ethylene oxide with 1 mol of tallow fatty amine;

$D_9$: The ammonium salt of the acid sulfuric acid diester of the adduct of 2 mols of ethylene oxide with 1 mol of stearylamine;

$D_{10}$: The ammonium salt of the sulfuric acid monoester of the adduct of 4, 6 or 8 mols of ethylene oxide with 1 mol of tallow fatty amine;

$D_{11}$: The ammonium salt of the acid sulfuric acid diester of the adduct of 1 mol of styrene oxide and 8 mols of ethylene oxide with 1 mol of dodecylamine;

EXAMPLE 1

Using a liquor ratio of 1:15, 1,400 g of textured polyester (polyethylene glycol terephthalate) in the form of a wound package are treated at 70° C. in a high temperature circulating liquor dyeing apparatus with an aqueous liquor which contains 42 g of ammonium sulfate, 10.8 ml of 80% aqueous formic acid and 63 g of an aqueous preparation (1) consisting of 8% of an ammonium salt of the formula (11) (component $A_1$), 20% of the acid phosphoric acid ester of the adduct of 10 mols of ethylene oxide with 1 mol of p-nonylphenol (component $B_{14}$), 50% of an ester mixture consisting of 13% of dibutyl succinate, 20% of dibutyl glutarate and 67% of dibutyl adipate, and 6% of polypropylene glycol with an average molecular weight of 400 and 16% of water. 0.28 g of a yellow dye of the formula

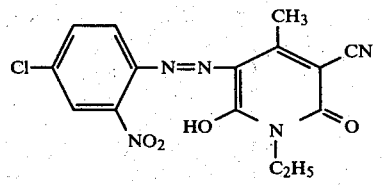

(101) t/2 = 50

0.84 g of a red dye of the formula

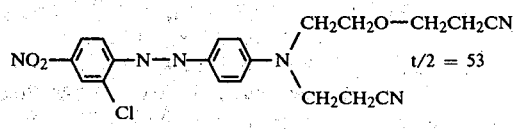

(102) t/2 = 53 and 1.26 g of a blue dye of the formula

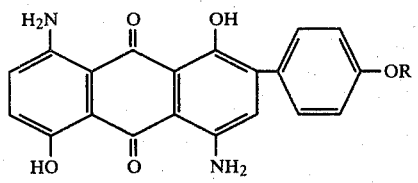

(103)

50% R = H
50% R = $CH_3$
t/2 = 90 are then added to the liquor, after which the liquor is allowed to circulate for 5 minutes at 70° C. The dye liquor is then heated up to 130° C. in the course of 20 minutes, the liquor being circulated at a rate of 3 circulations per minute, and is left at this temperature for 30 minutes. The dyebath is then cooled to 80° C. and the dyeing is rinsed and finished in the conventional manner.

If the outer, middle and inner layers of the polyester wound package, which has been dyed pale grey, are each knitted separately to give a piece of knitting, the knitting obtained displays completely level dyeing and the individual layers can virtually no longer be differentiated.

When the same procedure is repeated except that 21 g of the disodium salt of di-(6-sulfonaphth-2-yl)methane are added in place of the indicated assistant preparation (1), the pieces of knit polyester obtained after knitting display non-level dyeings.

In place of the preparation (1) indicated in the example, the following preparations (2) and (3) can also be employed with similar success: (2) Preparation consisting of 7% of the ammonium salt of the formula (11) (component $A_1$), 25% of dibenzyl ether, 24% of an ester mixture consisting of 13% of dibutyl succinate, 20% of dibutyl glutarate and 67% of dibutyl adipate, and 20% of the acid phosphoric acid ester of the adduct of 10 mols of ethylene oxide with 1 mol of p-nonylphenol (component $B_{14}$), 7% of polypropylene glycol with an average molecular weight of 400 and 17% of water; and (3) Preparation consisting of 8% of the ammonium salt of the formula (11) (component $A_1$), 20% of the acid phosphoric acid ester of the adduct of 10 mols of ethylene oxide with 1 mol of p-nonylphenol (component $B_{14}$), 50% of di-(2-ethyl-hexyl)adipate, 6% of polypropylene glycol with an average molecular weight of 400 and 16% of water.

When preparation (2) is used, the resulting dyeing is also subjected to a thermosol treatment for 1 minute at 165° C.

EXAMPLE 2

In three separate dyeings, 570 g of polyester textured yarn in each case are dyed, in the form of a muff, in a high temperature circulating liquor dyeing apparatus under high temperature conditions in the conventional manner and using a liquor ratio of 1:10, with the following dyes: 8.55 g of an orange dye of the formula

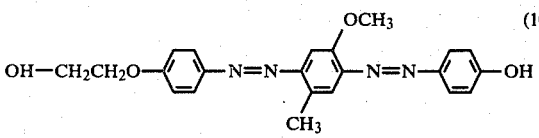

(104)

t/2 = 63

17.10 g of a red dye of the formula (102) and, respectively, 12.54 g of a blue dye of the formula (103), after which the three dyeings obtained are finished in the conventional manner. The three dyed polyester textured yarns (muffs) obtained are orange, scarlet and blue respectively. Using a liquor ratio of 1:10, the three dyed yarns (1,710 g) are put together into a liquor which contains 51.3 g of an aqueous assistant preparation (4), consisting of 7% of the ammonium salt of the formula (11) (component $A_1$), 18% of the acid phosphoric acid ester of the adduct of 10 mols of ethylene oxide with 1 mol of p-nonylphenol (component $B_{14}$), 55% of dibutyl adipate and 6% of polypropylene glycol with an average molecular weight of 400 and 14% of water. The liquor is then allowed to circulate at 70° C. for 5 minutes. The dye liquor is then heated to 130° C. in the course of 20 minutes and kept at this temperature for 120 minutes. The dye liquor is then cooled to 80° C. and the dyeing is finished in the customary manner.

After drying, a brown dyeing is obtained on the dyed load, which previously was made up of one orange coloured polyester muff, one scarlet coloured polyester muff and one blue coloured polyester muff.

If the outer, middle and inner layers of an individual polyester muff are each knitted separately to give a joined piece of knitting, the particular pieces of knitting obtained display astonishingly level dyeing when it is taken into consideration that the brown shade is made up of the three individual dyeings.

In place of components $A_1$ and $B_{14}$, components $A_2$ to $A_9$ and $B_1$ to $B_{13}$, $B_{15}$ and $B_{16}$ can each be employed in the assistant preparation (4) with similar success.

EXAMPLE 3

In a Callebaut de Blicquy bomb (high temperature dyeing apparatus), an aqueous liquor containing 0.1 g of the disodium salt of di-(6-sulfonaphth-2-yl)-methane, 0.2 g of ammonium sulfate, 0.05 ml of 80% aqueous formic acid and a dye mixture consisting of 0.018 g of an orange dye of the formula (104), 0.02 g of a red dye of the formula (102) and 0.0225 g of a blue dye of the formula (103) flows, at 70° C., through 10 g of a textured polyester fabric, the liquor ratio being 1:10. The dye liquor is then heated up from 70° C. to 130° C. at a heating rate of 1.5° per minute, after which the goods to be dyed are dyed at this temperature for 60 minutes. The dye liquor is then cooled to 70° C. and the dyed goods are rinsed and dried.

The olive coloured polyester fabric is rolled up together with 10 g of the same fabric which has not been dyed and, in the Callebaut de Blicquy bomb, a liquor containing 0.4 g of ammonium sulfate and 0.1 ml of 80% aqueous formic acid and 0.6 g of the assistant preparation (1) flows through the rolled fabric, at 70° C., the liquor ratio being 1:10. The liquor is then heated up from 70° C. to 130° C. as rapidly as possible and the material to be dyed is treated for 45 minutes at this temperature. The liquor is then cooled to 70° C. and the dyed goods are rinsed and dried.

A completely level, medium olive dyeing is obtained on the fabric which previously was undyed, whilst the material which originally was dyed has become considerably paler.

When the procedure described in Example 3 is repeated exactly, except that 0.1 g of the disodium salt of di-(6-sulfonaphth-2-yl)-methane is used in place of the indicated assistant preparation (1), the fabric which originally was undyed exhibits a pale olive dyeing which is not level and is unusable, and the depth of colour of the fabric which originally was dyed is lightened to only an insignificant extent.

EXAMPLE 4

Using a liquor ratio of 1:10, 10 g of a polyester textured fabric are treated at 60° C. in a Callebaut de Blicquy bomb with an aqueous dye liquor containing a dye mixture consisting of 0.002 g of a yellow dye of the formula (101), 0.0054 g of a red dye of the formula (102) and 0.009 g of a blue dye of the formula (105)

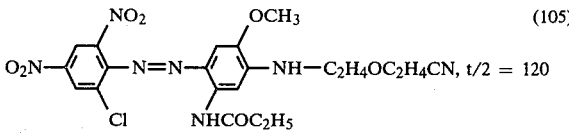

(105)

and 0.1 g of the disodium salt of di-(6-sulfonaphth-2-yl)-methane, 0.2 g of ammonium sulfate and 0.05 ml of 80% aqueous formic acid. The dye liquor is then heated up from 60° to 130° C. at a heating rate of 1.5° per minute, after which the material to be dyed is dyed for 60 minutes at this temperature. The dye liquor is then cooled to 70° C. and the dyed goods are rinsed and dried. The textured fabric, which has been dyed pale grey, is rolled up together with 10 g of an undyed fabric of the same material and the rolled material is treated, using a liquor ratio of 1:10, at 95° C. in a Callebaut de Blicquy rapid dyeing apparatus with an aqueous liquor containing 0.4 g of ammonium sulfate, 0.1 g of 80% aqueous formic acid and 0.6 g of assistant preparation (1), after which the temperature is raised to 130° C. as rapidly as possible. The material to be dyed is treated at this temperature for 45 minutes and the dye liquor is cooled to 70° C. The dyed goods are then rinsed and dried. A very level, solid pale grey dyeing is obtained on both pieces of fabric. This means that the dyeing on the piece which originally was undyed and the fabric dyed first have the same colour shade. Moreover, virtually no dye has remained in the treatment bath. When the procedure described in Example 4 is repeated, except that (a) 0.3 g of dibutyl adipate or (b) 0.3 g of a mixture consisting of 60% of a mixture of 20 parts of dibutyl succinate, 30 parts of dibutyl adipate and 50 parts of dibutyl glutarate, 20% of an adduct of 40 mols of ethylene oxide with 1 mol of castor oil and 20% of water is used in place of assistant preparation (1), an otherwise identical procedure yields, in both cases, pale grey dyeings on the fabric which originally was undyed, but these dyeings have a distinctly redder colour shade than the dyeing produced according to Example 4. When assistant (a) or (b) is used, the blue colour component of the trichromatic dyeing is more strongly retained in the dyebath. For this reason, a distinct shift in the colour shade results on migration.

EXAMPLE 5

The procedure described in Example 3 is repeated, except that 0.33 g of a violet dye of the formula

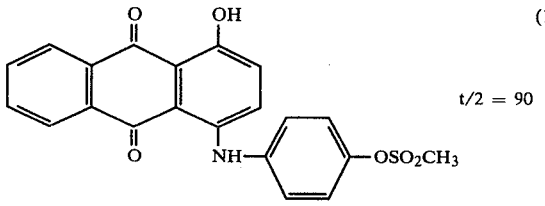

(106)

is used in place of the dye mixture indicated in the said example. A completely level violet dyeing is obtained on the fabric which originally was undyed. The depth of colour of the fabric which originally was dyed is greatly lightened. The migration time of half dyeing T/2 of this violet dye in the presence of the assistant is 16 minutes.

When Example 5 is repeated replacing the assistant preparation (1) by 0.1 g of the disodium salt of di-(6-sulfonaphth-2-yl)-methane, the fabric which originally was undyed displays merely a weak dyeing and the fabric which originally was dyed shows only insignificant lightening.

EXAMPLES 6 TO 25

The procedure described in Example 5 is repeated, except that, in each case, the dyes listed in the following table are used, in the amount indicated in the said table (column 3), in place of the violet dye indicated in Example 5. Dyeings are obtained in the colour shade which is indicated in the last column of the table. The migration time of half dyeing t/2 of the dye without the assistant mixture is shown in column four, whilst the shoretened migration time of half dyeing T/2 for the dye, which results when the assistant mixture is present, is shown, in minutes, in column five.

| Example | Dye | g | t/2 | T/2 | Colour shade |
|---|---|---|---|---|---|
| 6 | Formula (101) | 0.03 | 50 | 18 | yellow |
| 7 | 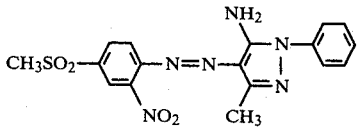 | 0.36 | 65 | 19 | yellow |
| 8 | Formula (104) | 0.15 | 63 | 25 | orange |
| 9 | 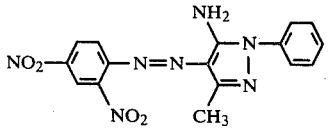 | 0.16 | 45 | 15 | orange |
| 10 | 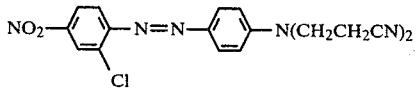 | 0.18 | 61 | 18 | orange |
| 11 | Formula (102) | 0.6 | 53 | 19 | scarlet |

-continued

| Example | Dye | g | t/2 | T/2 | Colour shade |
|---|---|---|---|---|---|
| 12 | 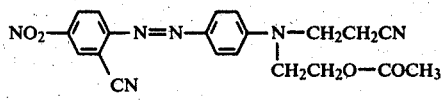 | 0.3 | 55 | 20 | red |
| 13 | 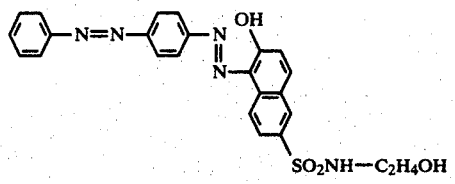 | 0.16 | 90 | 24 | red |
| 14 | 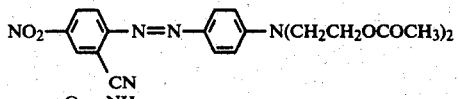 | 0.4 | 73 | 21 | red |
| 15 | 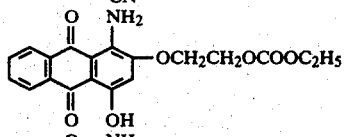 | 0.26 | 90 | 20 | rose-red |
| 16 | 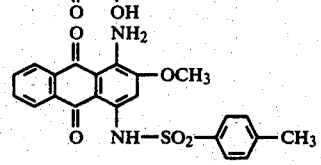 | 0.2 | 90 | 20 | rose-red |
| 17 | 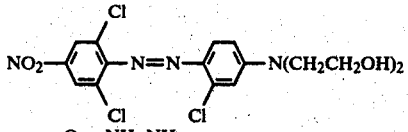 | 0.2 | 50 | 20 | brown |
| 18 | 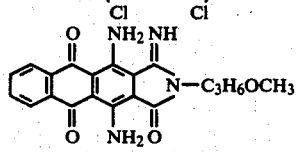 | 0.6 | 120 | 15 | blue |
| 19 | Formula (103) | 0.44 | 90 | 20 | blue |
| 20 | Formula (105) | 0.7 | 120 | 40 | blue |
| 21 | Mixture of the dyes according to Examples 10 and 20 (1:2) | 1.0 | 120 | 40 | black |
| 22 | 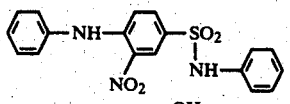 | 0.5 | 35 | 15 | yellow |
| 23 | 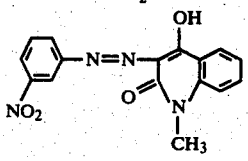 | 0.1 | 17 | 10 | yellow |
| 24 | 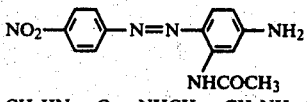 | 0.12 | 25 | 15 | red |
| 25 | 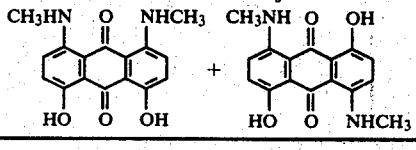 | 0.2 | 22 | 15 | blue |

EXAMPLE 26

In a high temperature circulating liquor dyeing apparatus, 2,000 g of a textured polyester (polyethylene glycol terephthalate), in the form of a wound package with a winding density of 450 g/cm$^3$, are allowed to circulate, at 80° C., in an aqueous liquor (liquor ratio 1:6), which contains 24 g of ammonium sulfate and the pH of which has been adjusted to 5 with formic acid. An aqueous preparation of 36 g of an assistant (5) in 200 g of water is added, the assistant consisting of 52% of an ester mixture, consisting of 13% of dibutyl succinate, 20% of dibutyl glutarate and 67% of dibutyl adipate, 16% of component $B_{14}$, 16% of component $A_1$ and 16% of component $D_6$. 19.8 g of a yellow dye of the formula according to Example 7, 15.6 g of a red dye of the formula (102) and 6.3 g of a blue dye of the formula (105) are then added to the liquor. The dye liquor is allowed to circulate through the goods for 10 minutes at 80° C. The dye liquor is then heated up from 80° C. to 130° C. in the course of 35 minutes, at a heating rate of 1½° C. per minute. The dye liquor is left at this temperature for 60 minutes, the liquor being allowed to flow through the goods to be dyed from the inside for 45 minutes and from the outside for 15 minutes.

The dye liquor is then cooled to 80° C. and the dyed goods are rinsed and dried.

If the outer, middle and inner layers of the polyester wound package, which has been dyed brown, are each separately knitted to give a piece of knitting, the resulting piece of knitting exhibits completely level dyeing and the individual layers can virtually no longer be differentiated.

When the same procedure is repeated, except that 21 g of the disodium salt of di-(6-sulfonaphth-2-yl)methane are added in place of the indicated assistant preparation (5), the knitted pieces of polyester obtained after knitting display unlevel dyeings.

A comparison of the migration times of half dyeing t/2 of the dyes used with and without the assistant mixture gives the following migration times of half dyeing: (t/2 without assistant mixture; T/2 with assistant mixture).

| Dye | t/2 | T/2 | Colour shade |
|---|---|---|---|
| Formula according to Example 7 | 65 | 20 | yellow |
| Formula 102 | 53 | 20 | scarlet |
| Formula 105 | 91 | 28 | blue |

EXAMPLE 27

In a high temperature circulating liquor dyeing apparatus (high temperature cheese dyeing apparatus), 1,400 g of a textured polyester yarn in the form of a wound package are allowed to circulate at 70° C. for 5 minutes in 21 liters of an aqueous liquor which contains 10.5 ml of 80% acetic acid, 52.5 g of the aqueous assistant preparation (5) and 14 g of aqueous 20% ground sand containing the fluorescent brightening agent of the formula

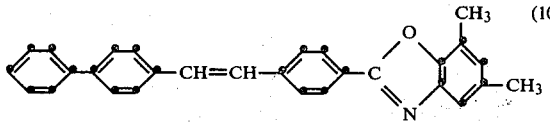

(107)

and the adduct of 35 mols of ethylene oxide with 1 mol of nonylphenol (1:1), particle size <2μ, the liquor ratio being 1:15. The liquor is then heated to 130° C. in the course of 20 minutes, at a liquor circulation rate of 3 circulations per minute, and is kept at this temperature for 30 minutes. After cooling the liquor to 80° C., the goods are rinsed twice with warm water, then centrifuged and dried at 120° C. If the outer, middle and inner layers of the brightened polyester wound package are each knitted separately to give a piece of knitting, no difference in the whiteness can be detected between the three pieces of knitting. The entire piece of knitting has been whitened completely evenly.

When the same procedure is repeated, but without the addition of the assistant preparation (5), pieces of knit polyester which have been whitened unevenly and, moreover, have low whiteness, are obtained after knitting.

EXAMPLE 28

Using a liquor ratio of 1:7, 2,000 g of a textured polyester (polyethylene glycol terephthalate), in the form of a wound package with a winding density of 450 g/cm³, are treated at 80° C. in a high temperature circulating liquor dyeing apparatus with an aqueous liquor which contains 7 ml of 80% aqueous formic acid, 28 g of ammonium sulfate, 200 g of an aqueous preparation containing 42 g of assistant (5), and 7 g of calcium chloride dissolved in 500 ml of water. 28 g of an orange dye of the formula according to Example 9 are then added to the liquor, after which the liquor is allowed to circulate for 5 minutes. The dyeing temperature is raised to 130° C. at a heating rate of 1.5° C. per minute and dyeing is then carried out for 60 minutes at this temperature, the liquor being circulated 3 times per minute. The dyebath is then cooled to 80° C. and the dyed goods are rinsed and dried.

If the outer, middle and inner layers of the polyester wound package, which has been dyed brilliant orange, are each knitted separately to give a piece of knitting, the dyeing of the resulting knitting is completely level and the individual layers can virtually no longer be differentiated. Moreover, no dye deposits are visible.

In place of component $D_6$, an equal amount of components $D_1$ to $D_5$ or $D_7$ to $D_{11}$ can in each case also be employed in the assistant preparation (5) of Examples 26, 27 and 28, with equal success.

What is claimed is:

1. An assistant for the dyeing or fluorescent brightening which comprises at least (A) an acid ester, or a salt thereof, of a polyadduct of propylene oxide with a polyfunctional aliphatic amino or hydroxy compound with contains 2 to 9 carbon atoms and has at least one amino or hydroxyl group capable of entering into an addition reaction;

(B) an acid ester, or a salt thereof, of a polyadduct of an alkylene oxide with a phenol containing at least one alkyl, benzyl or phenyl group and (C) an aliphatic ester, containing at least 6 carbon atoms, of a mono- or di-carboxylic acid.

2. An assistant according to claim 1, wherein component (A) is an acid ester, or a salt thereof, of a polypropylene oxide adduct which has an average molecular weight of 1,000 to 6,000.

3. An assistant according to claim 1, wherein the polypropylene oxide adduct has been obtained by adding 40 to 80 mols of propylene oxide onto 1 mol of a polyfunctional aliphatic hydroxy compound containing 2 to 9 carbon atoms.

4. An assistant according to claim 3, wherein the aliphatic hydroxy compound is a polyhydric aliphatic alcohol which has 2 to 6 hydroxyl groups and 2 to 6 carbon atoms.

5. An assistant according to claim 4, wherein the polyhydric aliphatic alcohol has 2 or 3 hydroxyl groups and 3 carbon atoms.

6. An assistant according to claim 1, wherein component (B) is an acid ester, or a salt thereof, of a polyalkylene oxide adduct which has been obtained by adding 1 to 60 mols of alkylene oxide onto 1 mol of a phenol which contains at least one benzyl group, one phenyl group or one alkyl group of at least 4 carbon atoms.

7. An assistant according to claim 6, wherein component (B) is an anionic surfactant of the formula

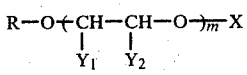

(1)

in which R is alkylphenyl having 4 to 16 carbon atoms in the alkyl moiety or o-phenylphenyl, one of $Y_1$ and $Y_2$ is hydrogen or methyl and the other is hydrogen, X is the acid radical of an inorganic, oxygen-containing acid and m is 1 to 30.

8. An assistant according to claim 7, wherein component (B) is an anionic surfactant of the formula

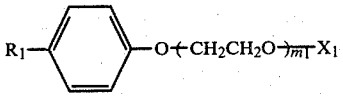

(2)

in which $R_1$ is octyl or nonyl, $m_1$ is 2 to 15 and $X_1$ is derived from sulfuric acid or o-phosphoric acid, and the surfactant is in the form of the free acid or of the sodium or ammonium salt.

9. An assistant according to claim 1, wherein component (C) is an aliphatic ester, having 6 to 24 carbon atoms, of a mono- or di-carboxylic acid with an aliphatic alcohol of 1 to 18 carbon atoms.

10. An assistant according to claim 9, wherein component (C) is an aliphatic diester, having 10 to 24 carbon atoms, of a dicarboxylic acid with an aliphatic alcohol of 3 to 12 carbon atoms.

11. An assistant according to claim 10, wherein component (C) is a mixture of the dipropyl esters, dibutyl esters or di-2-ethylhexyl esters of succinic acid, glutaric acid and adipic acid.

12. An assistant according to claim 1, which contains at least (Aa) a sulfuric acid ester, or a salt thereof, of a polyadduct of 40 to 80 mols of propylene oxide with a dihydric to hexahydric aliphatic alcohol of 2 to 6 carbon atoms, (Bb) an acid ester, or a salt thereof, of a polyadduct of 2 to 20 mols of ethylene oxide, propylene oxide or a mixture of said oxides with a p-alkylphenol having 4 to 16 carbon atoms in the alkyl moiety and (Cc) an aliphatic diester, having 10 to 24 carbon atoms, of an aliphatic dicarboxylic acid.

13. An assistant according to claim 1, which additionally contains, as component (D), an anionic or amphoteric ester, or a salt thereof, of a polyadduct of 2 to 50 mols of an alkylene oxide with an aliphatic monoamine of 8 to 24 carbon atoms.

14. An assistant according to claim 13, wherein component (D) is a compound of the formula

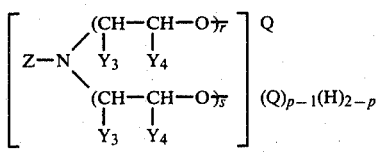

(3)

in which one of $Y_3$ and $Y_4$ is hydrogen, methyl or phenyl and the other is hydrogen, Z is an aliphatic hydrocarbon radical having 8 to 24 carbon atoms, the two Qs, on their own or together, are the acid radical of an inorganic oxygen-containing acid or of an aliphatic dicarboxylic acid, p is 1 or 2 and r and s are integers, the sum of r and s being 2 to 50.

15. An assistant according to claim 14, wherein component (D) is a compound of the formula

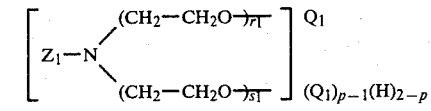

(4)

in which $Z_1$ is alkyl or alkenyl, each having 10 to 18 carbon atoms, and p is 1 or 2, the sum of $r_1$ and $s_1$ is 2 to 15 and the two $Q_1$s are derived from sulfuric acid or, individually or together, from o-phosphoric acid, and the compound of the formula (4) is in the form of the free acid or of the sodium or ammonium salt.

16. An assistant according to claim 15, wherein component (D) consists of a mixture of the compounds of the formulae

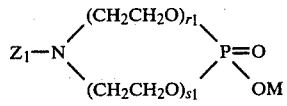

(4a)

and

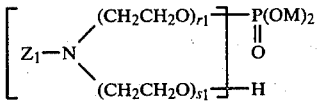

(4b)

in which $Z_1$, $r_1$ and $s_1$ are as defined in claim 15 and M is hydrogen, ammonium or sodium.

17. An assistant according to claim 1, which additionally contains, as component (E), a polypropylene glycol or an adduct of propylene oxide with a trihydric to hexahydric aliphatic alcohol of 3 to 6 carbon atoms.

18. An assistant according to claim 1, which contains, based on the assistant, 5 to 20 percent by weight of component (A), 10 to 40 percent by weight of component (B), 15 to 60 percent by weight of component (C) and 0 to 40 percent by weight of water.

19. An assistant according to claim 18, which additionally contains, as component (D), 2 to 25 percent by weight, based on the assistant, of an anionic or amphoteric ester, or a salt thereof, of a polyadduct of 2 to 50 mols of an alkylene oxide with an aliphatic monoamine of 8 to 24 carbon atoms.

20. An assistant according to claim 18, which additionally contains, as component (E), 3 to 10 percent by weight, based on the assistant, of a polypropylene glycol or of an adduct of propylene oxide with a trihydric to hexahydric aliphatic alcohol of 3 to 6 carbon atoms.

21. A process for the dyeing or fluorescent brightening of polyester fibre material with a disperse dye or dispersed fluorescent brightener, wherein the material is dyed or subjected to fluorescent brightening in the presence of an assistant which contains at least (A) an acid ester, or a salt thereof, of a polyadduct of propylene oxide with a polyfunctional aliphatic amino or hydroxy compound which contains 2 to 9 carbon atoms and has at least one amino or hydroxyl group capable of entering into an addition reaction;

(B) an acid ester, or a salt thereof, of a polyadduct of an alkylene oxide with a phenol containing at least one alkyl, benzyl or phenyl group and (C) an aliphatic ester, containing at least 6 carbon atoms, of a mono- or di-carboxylic acid.

22. A process according to claim 21, wherein the assistant additionally contains, as component (D) an anionic or amphoteric ester, or a salt thereof, of a polyadduct of 2 to 50 mols of an alkylene oxide with an aliphatic monoamine of 8 to 24 carbon atoms.

23. A process according to claim 21, wherein the assistant additionally contains, as component (E), a polypropylene glycol or an adduct of propylene oxide with a trihydric to hexahydric aliphatic alcohol of 3 to 6 carbon atoms.

24. A process according to claim 21, wherein the assistant is used in an amount of 0.5 to 6 g per liter of dye liquor or brightener liquor.

25. A process according to claim 21, wherein the dye liquor or brightener liquor additionally contains an anionic dispersant.

26. A process according to claim 21, wherein the dye liquor or brightener liquor additionally contains a carrier.

27. A process according to claim 21, wherein the dye liquor or brightener liquor additionally contains a water-soluble alkaline earth metal salt, aluminium salt or organic ammonium salt of a monobasic or polybasic aliphatic carboxylic acid or of a monobasic or polybasic inorganic acid.

28. A process according to claim 27, wherein the liquor contains calcium chloride or magnesium chloride as the alkaline earth metal salt.

29. A process according to claim 21, wherein dyeing or fluorescent brightening is carried out at a temperature of 80° to 135° C.

30. A process according to claim 29, wherein the temperature is of 110° to 135° C.

31. A process according to claim 21, wherein the fibre material is put into the liquor at 60° to 80° C., the liquor is heated to 110° to 135° C. in the course of 15 to 35 minutes and dyeing is carried our at this temperature for 30 to 120 minutes.

32. A process according to claim 21, wherein a disperse dye or fluorescent brightener is used which, without assistants, has a migration time of half dyeing t/2 of at least 40 minutes at 130° C.

33. A process according to claim 21, wherein at least two or three disperse dyes are used.

34. An aqueous liquor for the dyeing or fluorescent brightening of polyester fibre material, which comprises at least one disperse dye or one dispersed fluorescent brightener and an assistant containing at least (A) an acid ester, or a salt thereof, of a polyadduct of propylene oxide with a polyfunctional aliphatic amino or hydroxy compound which contains 2 to 9 carbon atoms and has at least one amino or hydroxyl group capable of entering into an addition reaction; (B) an acid ester, or a salt thereof, of a polyadduct of an alkylene oxide with a phenol containing at least one alkyl, benzyl or phenyl group and (C) an aliphatic ester, containing at least 6 carbon atoms, of a mono- or di-carboxylic acid.

35. An aqueous liquor according to claim 34, which additionally contains at least one of the components (D) an anionic or amphoteric ester, or a salt thereof, of a polyadduct of 2 to 50 mols of an alkylene oxide with an aliphatic monoamine of 8 to 24 carbon atoms and (E) a polypropylene glycol or an adduct of propylene oxide with a trihydric to hexahydric aliphatic alcohol of 3 to 6 carbon atoms.

36. An aqueous liquor according to claim 34, which additionally contains a water-soluble alkaline earth metal salt, aluminium salt or organic ammonium salt of a monobasic or polybasic aliphatic carboxylic acid or of a monobasic or polybasic inorganic acid.

* * * * *